United States Patent [19]

Inada

[11] Patent Number: 4,746,116

[45] Date of Patent: May 24, 1988

[54] UNIVERSAL PHYSICAL EXERCISING DEVICE

[76] Inventor: Taichi Inada, 120-banchi, 1-Chome, Niwai-Chou, Sumiyoshi-ku, Osaka City, Japan

[21] Appl. No.: 884,401

[22] Filed: Jul. 11, 1986

[51] Int. Cl.[4] ..... A63B 21/00

[52] U.S. Cl. ..... 272/144; 272/33 R; 272/145

[58] Field of Search ..... 272/33 R, 38, 49, 50, 272/144, 145, 146; 128/71-75

[56] References Cited

U.S. PATENT DOCUMENTS

| | | | |
|---|---|---|---|
| 3,141,669 | 7/1964 | Yun Chul | 272/33 R |
| 3,276,777 | 10/1966 | Pruitt, Sr. | 272/33 R |
| 3,519,268 | 7/1970 | McQueen | 272/144 X |
| 3,936,047 | 2/1976 | Brandt et al. | 272/146 |
| 4,113,250 | 9/1978 | Davis | 272/146 X |
| 4,566,693 | 1/1986 | Seidentor et al. | 272/144 |
| 4,608,969 | 9/1986 | Hamlin | 128/71 |
| 4,618,145 | 10/1986 | Inada | 272/146 |

FOREIGN PATENT DOCUMENTS

| | | | |
|---|---|---|---|
| 664177 | 6/1963 | Canada | 272/33 R |

*Primary Examiner*—Richard J. Apley
*Assistant Examiner*—Robert D. Bahr
*Attorney, Agent, or Firm*—McGlew and Tuttle

[57] ABSTRACT

A universal physical exercising device includes in combination: a collapsable base supporting frame; a horizontal frame rotatably connected to the base supporting frame through a pair of pivot joints; an adjustable vertical frame structure with a handle member and a pair of vertical sides longitudinally pivoted to a center portion of the horizontal frame; and an elliptical pedal member with foot straps and safety belt fixed at a lower end of the vertical sides of the vertical frame structure. The base supporting frame and the horizontal frame are also provided with a plurality of detachable connecting members for holding the horizontal frame in stationary condition for allowing the vertical frame structure to be operated as a single unit while the vertical frame structure also includes a plurality of anchoring elements for being optionally connected to the horizontal frame so as to be consolidated together for performing either swinging or rotation exercises therewith.

2 Claims, 6 Drawing Sheets

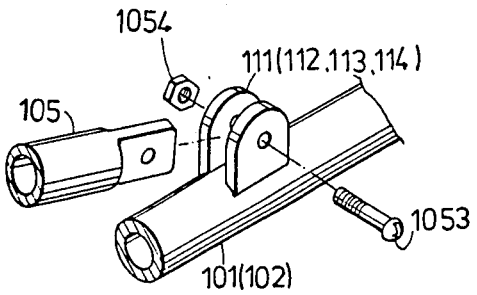
F I G. 2
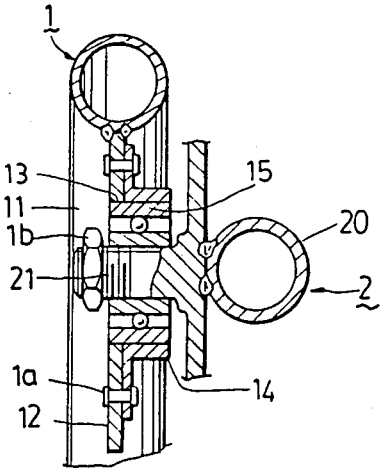
F I G. 3 (3-3')
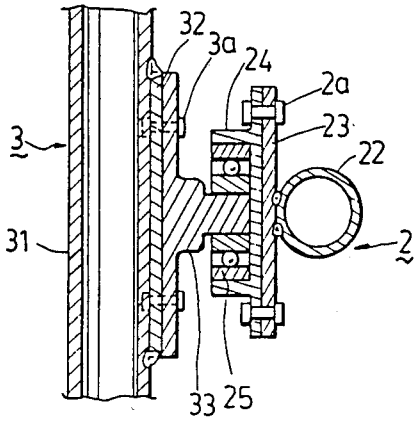
F I G. 4 (4-4')

UNIVERSAL PHYSICAL EXERCISING DEVICE

BACKGROUND OF THE INVENTION

This invention relates to a universal physical exercising device, particularly to that type of exercising device having a U-shaped vertical frame structure and a pedal member movably connected to a horizontal frame, which is pivotally installed in a collapsable base supporting frame, for facilitating full kinematic exercise therewith.

Various physical exercising devices have long been developed for personal interests in promoting physical health and body fitness. However, the structure of the known physical exercising devices, particularly the structure of the hand grip and foot plate, is not satisfactory for performing full kinematic exercise, as can be seen in the exercising device shown in U.S. Pat. No. 3,276,777 issued to Pruit, et al. In FIGS. 1 and 2 of the U.S. Pat. No. 3,276,777, the structure of the inner frame (13), together with the hand bar (53), can provide only a single hand grip (55) for the user to hold in one position, resulting in rather tedious and boring exercise for the user.

SUMMARY OF THE INVENTION

It is accordingly a primary object of this invention to provide a novel universal physical exercising device in which the user's hands can hold the device either in front of his body or at his back, or at both sides of his body as required during exercise.

It is another object of this invention to provide a novel universal physical exercising device with which the user can optionally select the rotating pattern such as to rotate to and fro or left and right, and then, when the user becomes skilled at exercising, with which a 360-degree vertical or horizontal rotation can also be selected.

It is still another object of this invention to provide a novel universal physical exercising device of which all parts can be easily detached from each other for storing and space-saving purposes.

These and other objects of the invention are achieved by providing a novel universal physical exercising device according to this invention, which exercising device comprises in combination: a collapsable base supporting frame; a horizontal frame rotatably connected to the base supporting frame; and a vertical frame provided with a hand holding member and a pedal member longitudinally pivoted to a center portion of the horizontal frame. The vertical frame also includes a plurality of movable means, with which the vertical frame can be adjusted to suit various heights of persons to be positioned therein, and fastening means disposed on the pedal member for securing the feet of a user on the pedal member. Therefore, with the exercising motion of the user's waist, arm and thigh muscles, as well as the feet, the vertical frame safely will swing back and forth within the horizontal frame; while, the swing of the vertical frame can be gradually developed to match with the rotation through the horizontal frame when the user's skill becomes proficient, so as to attain full kinermatic exercise therewith.

Other features and advantages of the present invention will become clear in the following detailed description when read in connection with the accompanying drawings.

BRIEF DESCRIPTION OF THE DRAWINGS

FIG. 2 is a partially enlarged view of a socket and spigot assembly, indicating the way in which the combination of components of the preferred embodiment shown in FIG. 1 is made according to this invention;

FIG. 3 is a sectional view of a pivot joint between a horizontal frame and a base supporting frame of the preferred embodiment, taken along lines 3-3' of FIG. 1;

FIG. 4 is a sectional view of a pivot joint between a vertical fram and the horizontal frame of the preferred embodiment, taken along lines 4-4' of FIG. 1;

DETAILED DESCRIPTION OF THE PREFERRED EMBODIMENT

Figure 1:
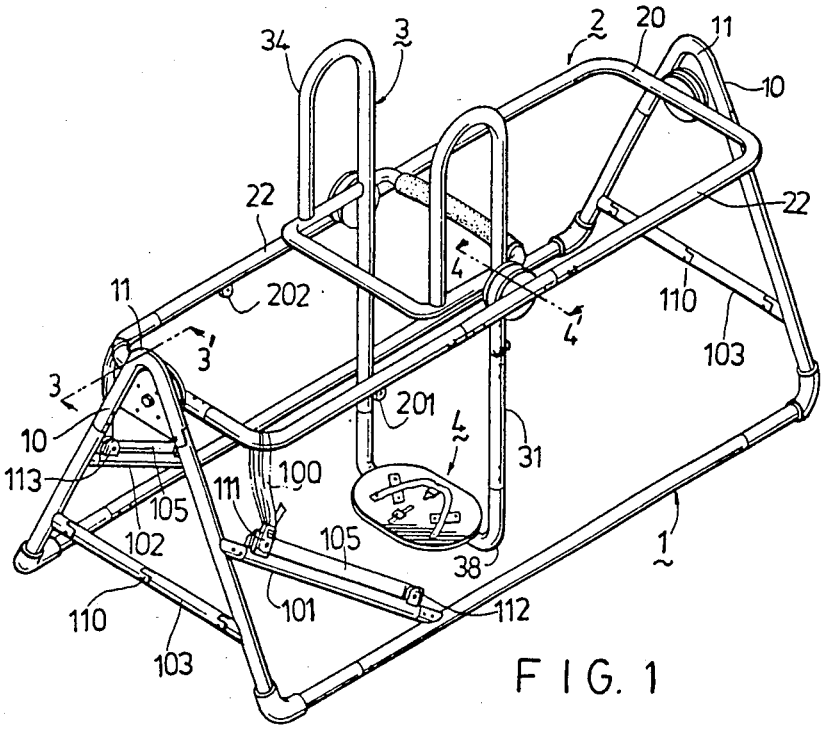
FIG. 1 is a perspective view of a preferred embodiment of a universal physical exercising device according to this invention.

Referring to FIG. 1, the preferred embodiment of a universal physical exercising device according to this invention includes in combination: a collapsable base supporting frame 1 formed in a general triangular shape as viewed from one side thereof; a rectangular horizontal frame 2 pivotally connected to the collapsable base supporting frame 1; a vertical frame structure 3 movably connected to the horizontal frame 2; and a pedal member 4 fixedly connected to a lower end of the vertical frame structure 3.

Figure 1A:
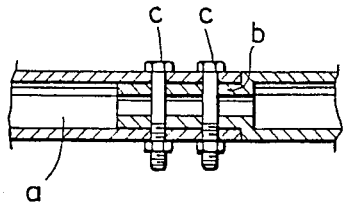
FIG. 1(A) is a partical sectional view of a socket and spigot joint provided in the preferred embodiment of FIG. 1.

Referring to FIG. 1(A), the combination of the collapsable base supporting frame 1, the horizontal frame 2 and the vertical frame structure 3 is made through socket and spigot pipes. As can be best seen in the drawing, each of the spigot joints provided for frames 1, 2 and 3 includes a male portion a, a female portion b for being received in the male portion a, and a plurality of bolts c detachably fixing the male portion a and the female portion b together through a plurality of bolt openings formed in both the male portion a and the female portion b. As shown in FIG. 1, the base supporting frame 1 also includes a plurality of reinforced guy members 101 and 102 respectively provided at a lower portion thereof, and a plurality of movable knuckles 110 located at a center point of each cross member 103 and at a lower part of each angled vertex portion 10 so that the base supporting frame 1 can be conveniently collapsed.

Referring to FIG. 3, there is shown a sectional view taken from line 3-3' of FIG. 1 to indicate the arrangement of a pair of pivot joints of the collapsable base supporting frame 1, which includes a pair of pivot joints disposed at the opposing vertex angled portions 10 of the frame 1. Each of the pivot joints is located at the angled vertex portion 10, and each pivot joint includes an angled pipe 11, a plate member 12 with a round opening in the center thereof welded on one side of the angled pipe 11, a bearing block 14 fixed on the plate member 12 through a plurality of bolts 1a, a first bearing 15 insertedly disposed in the opening 13 of the bearing block 14, and a round axle 21 welded on a center point of each short side 20 of the horizontal frame 2 and separately secured in the first bearing 15 through a nut **2*b*. With the arrangement of the pivot joints respectively located between each angled vertex portion 10 of the base supporting frame 1 and each short side 20 of the horizontal frame 2, the horizontal frame 2** can be conveniently swung left and right as well as horizontally rotated in 360 degrees along the pivot joints.

Referring to FIG. 4, there is also a sectional view taken from line 4-4' of FIG. 1 to indicate the arrangement of a second pair of pivot joints disposed at a center portion of the opposing long sides 22 of the horizontal frame 2. Each of the pivot joints includes: a first circular plate 23 welded on the long side 22 of the horizontal frame 2; a second bearing block 24 fixed on the first circular plate 23 through a plurality of bolts **2*a*; and a second bearing 25 insertedly disposed in the second bearing clock 24; a second circular plate 32 welded on a vertical side 31 of the vertical frame structure 3; and a round axle 33 having a base fixed on the second circular plate 32 through a plurality of screw bolts 3*a* and an axle end rotatably engaged in the second bearing 25. Thereby, the vertical frame structure 3 can be conveniently swung to and fro in the horizontal frame 2 as well as vertically rotated in 360 degrees with the horizontal frame 2 being held in stationary condition on the base supporting frame 1**. Details will be described in the following paragraphs.

Figure 7:
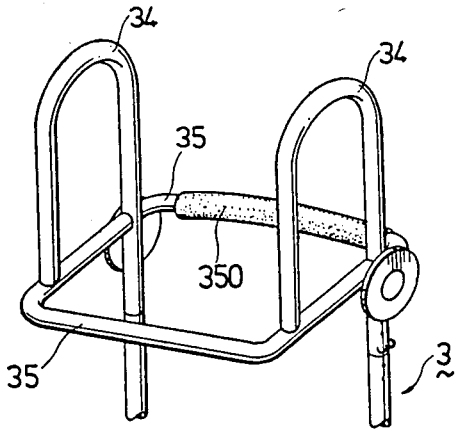
FIG. 7 is an enlarged illustrative view of a handle grip integrally formed on top of the vertical frame and a safety belt movably attached to the handle grip.

Referring to FIG. 7, the vertical frame structure 3 includes a pair of opposing U-shaped hand grips 34 provided at its top portion, and a pair of horizontal handles 35 parallelly disposed at a lower end of the U-shaped hand grips 34 wherein one of the horizontal handles 35 is fixedly provided with a soft pad 350 around the handle surface. The padded horizontal handle 35 is formed in a curve similar to the curve of a person's back so as to facilitate the user's leaning against the padded horizontal handle during exercise. In addition, each lower portion of the two vertical sides 31 of the vertical frame structure 3 are also formed with more than one sections, and each section includes a male portion and a female portion with a plurality of openings integrally provided in both portions for being detachably connected by a plurality of bolts (not shown) so that the height of the vertical frame structure 3 at the lower portion can be adjusted according to how tall the user is.

As shown in FIGS. 1 and 2, the base supporting frame 1 is also provided with a plurality of connecting rods 105, each of which is detachably coupled with each one of the reinforced guy members 101 and 102. In normal condition, both ends of each connecting rod 105 are movably connected to a pair of flange joints 111, 112, 113 and 114, which are integrally formed on each one of the guy members 101 and 102, through a plurality of bolts 1053 and nuts 1054, as shown in FIG. 2. For making connection with the horizontal frame 2, a plurality of flange joints 201 and 202 are also located on the lower surface of the long sides 22 of the horizontal frame 2 in conjunction with the flange joints 111 and 113 respectively located on the upper portion of each one of the guy members 101 and 102.

Figure 5:
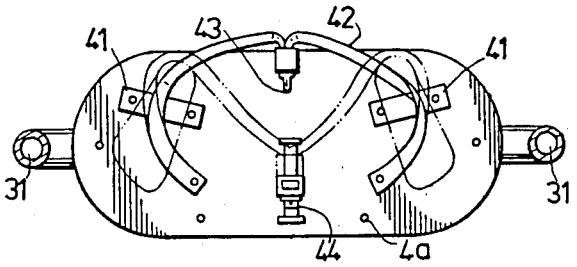
FIG. 5 is a top illustrative view of a pedal member of the preferred embodiment shown in FIG. 1.
Figure 5A:
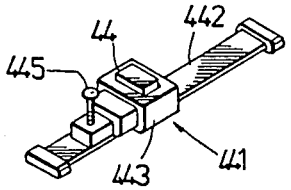
FIG. 5(A) is a perspective view of a lock catch arrangement provided in the preferred embodiment of FIG. 5.
Figure 6:
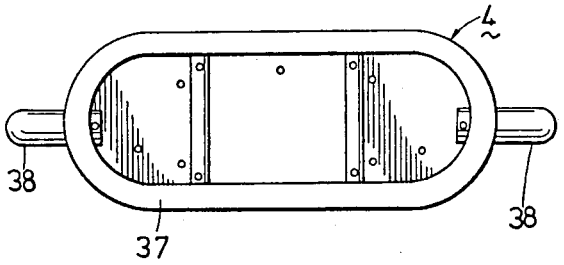
FIG. 6 is a bottom illustrative view of the pedal member of FIG. 5.

Referring to FIGS. 5 and 6, both vertical sides 31 of the vertical frame structure 3 are respectively formed in an L-shaped portion 38 at their lower end, and an elliptical frame 37, similar to the shape of the pedal member 4, is fixedly welded on the bottom of the L-shaped portions 38, as shown in FIG. 6, so as to facilitate the securing of the pedal number 4 on top of the elliptical frame 37. Elements provided on top of the pedal member 4, which is fixed on top of the eliptical frame 37 by a plurality of screw bolts **4*a*, as shown in FIG. 5, includes a pair of foot toggle straps 41 respectively disposed on the surface of the pedal member 4 at a proper distance; a safety belt 42 arranged over the foot toggle straps 41 with a belt fastener 43 provided at a middle portion for being connected to a lock catch 44 fixed on the pedal member 4. As shown in FIG. 5A, the lock catch 44 is combined with an adjusting mechanism 441, which includes a sliding track 442, a sliding block 443 where the lock catch 44 is located, and an adjusting rod 445 coupled with the sliding block 443. When the belt fastener 43 is secured at the lock catch, by operating the adjusting rod 445 together with the sliding block 443 and the belt fastener 43 along the sliding track 442, the safety belt 42** can be tightly retained around the heel portions of the user's feet for performing rotating exercise.

Figure 8:
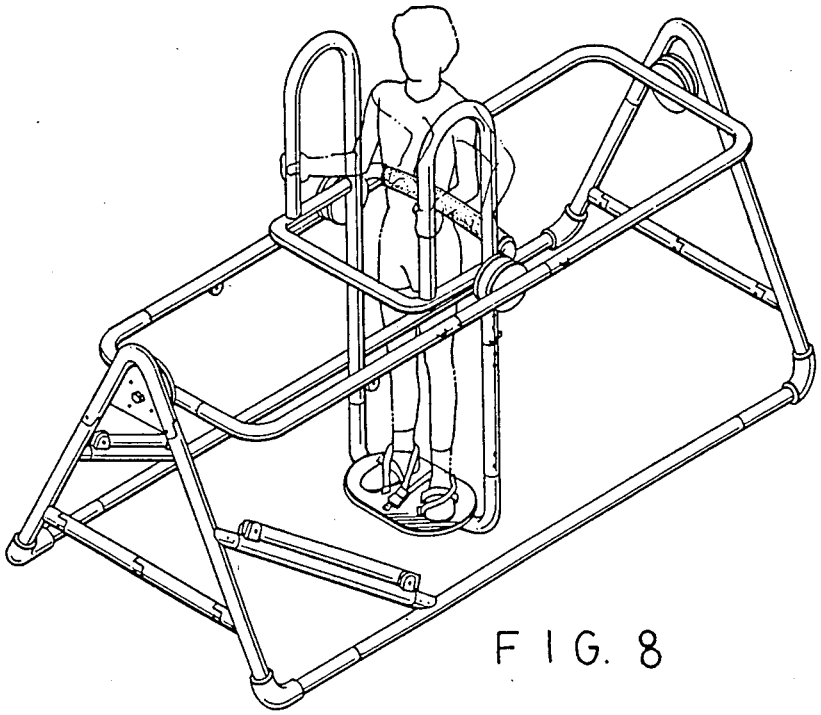
FIG. 8 (A, B, C) is a perspective view of the preferred embodiment shown in FIG. 1 and prepared in different exercise mode when a person using the device is ready to exercise therewith.
Figure 8A:
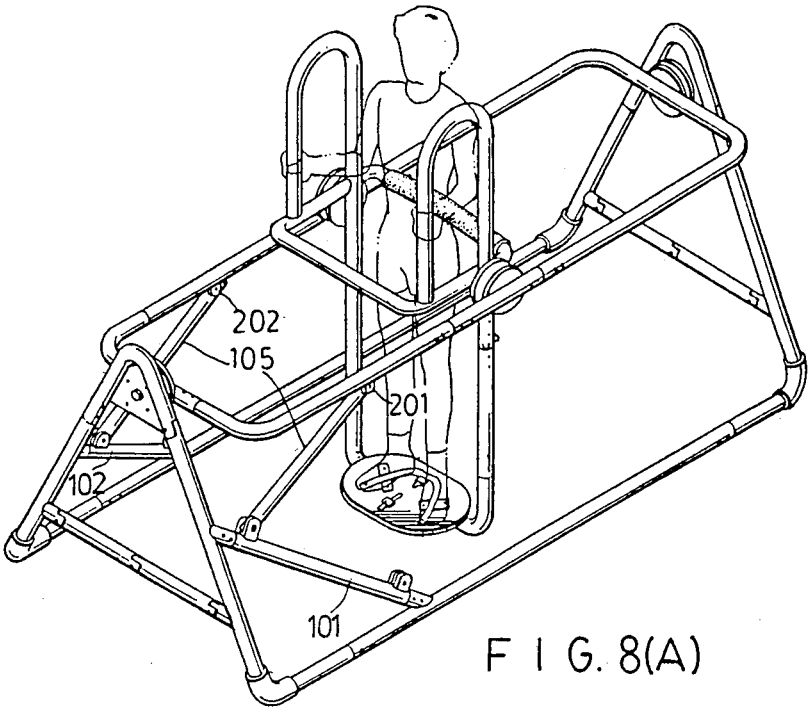
Figure 8B:
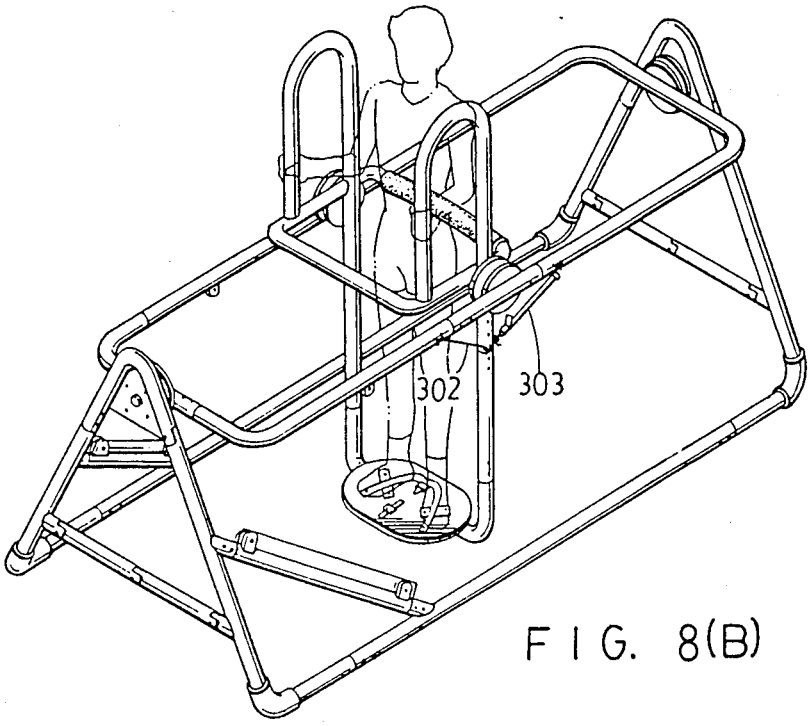
Figure 8C:
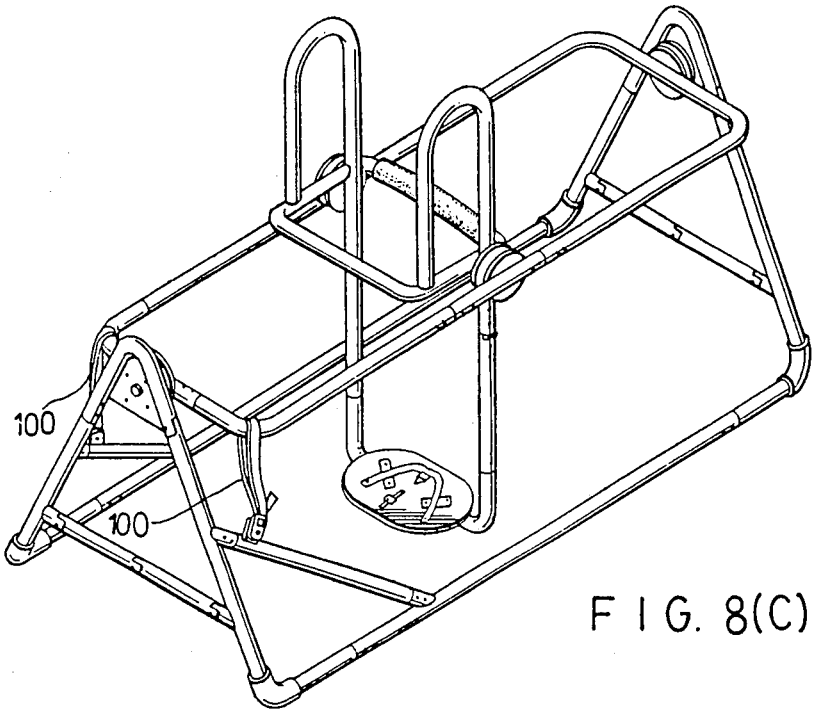

In using the device, as shown in FIG. 8 (A, B, C), the front portions of the user's feet are separately held in the foot toggle straps 41 while the heel portions are respectively retained by the safety belt 42 with the belt fastener 43 engaged in the lock catch 44. In the beginning, the user may hold the horizontal hand grip 35 for swinging to and fro or a little left and right along with the horizontal frame 2. Since the user's hands are holding the horizontal hand grip 35, no rotating exercise can be performed thereat. On the other hand, if only to and fro swinging exercise is to be practised or if a vertical 360-degree rotation is to be performed, the horizontal frame 2 can be temporarily fixed on the base supporting frame 1 through the connectiing rods 105 of which the lower ends are respectively disconnected from the flange joints 112 and 114 of the guy members 101 and 102 and detachably connected to the flange joints 201 202 of the horizontal frame 2, as shown in FIG. 8(A). Alternatively, a fastening belt 100, as shown in FIGS. 1 and 8(C), can also be used to tie the horizontal frame 2 to any one of the guy members 101 and 102 of the base supporting frame 1 so as to keep the horizontal frame 2 in a stationary condition. In this condition, the vertical frame structure 3 can be operated either to swing to and fro or to rotate vertically in 360 degrees in the horizontal frame 2 when the user becomes proficient in the exercise. On the other hand, the vertical frame structure 3 is also provided with a fastening belt 303 and a hook member 302, which are used to unite the vertical frame structure 3 with the horizontal frame 2 as a single unit so as to perform 360-degree rotating exercise when the user becomes proficient, as shown in FIG. 3(B). It shall be appreciated that when performing 360-degree rotating exercise, the user has to hold the vertical hand grip 34 for facilitating the rotating movement.

Figure 9:
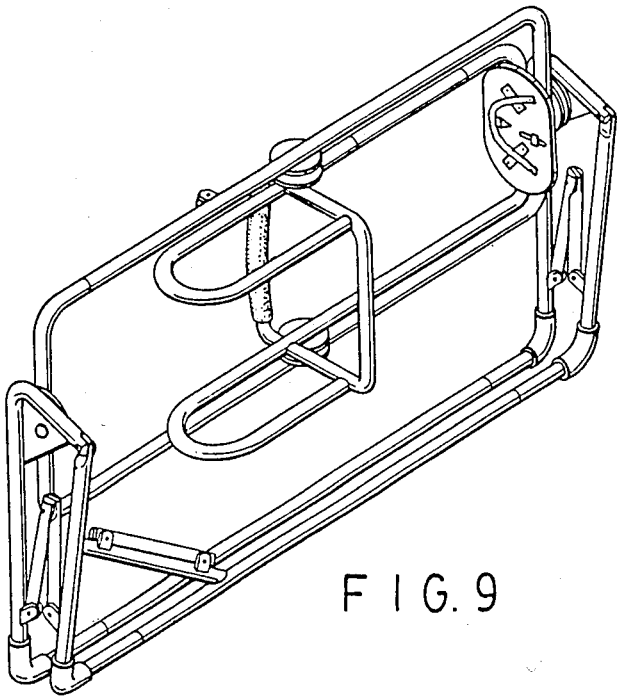
FIG. 9 is an illustrative view showing the preferred emobodiment of FIG. 1 being collapsed for storage.

Since the base supporting frame 1 is provided with a plurality of movable knuckles 110 at the cross members 11 in the lower portion and the opposing vertex angled portions 10, the complete exercise device according to this invention can be conveniently collapsed, as shown in FIG. 9, for being stored.

Certain modifications and improvements will occur to those skilled in the art upon reading the foregoing. It should be understood that all such modifications and improvements have been deleted herein for the sake of conciseness and readability but are properly within the scope of the following claims.

What is claimed is:

1. In a universal physical exercising device including a collapsible base supporting frame, a rectangular horizontal frame pivotally connected to an upper end of said collapsible base supporting frame and an adjustable vertical frame structure having an L-shaped portion formed at a lower end thereof pivotally coupled to said rectangular horizontal frame; the combination therewith comprising:

(a) a hand holding means provided at an upper end of said adjustable vertical frame for gripping at alternate positions during various exercises;

(b) pedal means affixed to said L-shaped portion of said adjustable vertical frame structure, said pedal means having a pair of foot toggle elements and a foot engaging safety member provided thereon; and (c) anchoring means respectively provided on said collapsible base supporting frame, said rectangular horizontal frame and said adjustable vertical frame for detachably securing said horizontal frame to said collapsible base supporting frame and said adjustable vertical frame to said rectangular horizontal frame in performing various exercises, whereby exercises which require a swinging to-and-fro, moving left-and-right and rotating 360 degrees can be either vertically or horizontally performed accordingly, said pedal means being of elliptical shape and said foot engaging safety member comprises a safety belt, said elliptical pedal means further comprising a belt fastener provided at a middle portion of said safety belt, an adjusting mechanism, including a sliding track fixed along a center line between said foot toggle elements, a sliding block with a lock catch movably provided on said sliding track for detachable engagement with said belt fastener, and an adjusting rod disposed at said sliding block so that, by operating said adjusting rod, said safety belt can be properly adjusted about the user's heels.

2. In a universal physical exercising device including a collapsible base supporting frame, a rectangular horizontal frame pivotally connected to an upper end of said collapsible base supporting frame and an adjustable vertical frame structure having an L-shaped portion formed at a lower end thereof pivotally coupled to said rectangular horizontal frame; the combination therewith comprising:

(a) an hand holding means provided at an upper end of said adjustable vertical frame for gripping at alternate positions during various exercises;

(b) pedal means affixed to said L-shaped portion of said adjustable vertical frame structure, said pedal means having a pair of foot toggle elements and a foot engaging safety member provided thereon; and (c) anchoring means respectively provided on said collapsible base supporting frame, said rectangular horizontal frame and said adjustable vertical frame for detachably securing said horizontal frame to said collapsible base supporting frame and said adjustable vertical frame to said rectangular frame in performing various exercises, whereby exercises which require swinging to-and-fro, moving left-and-right and rotating 360 degrees can be either vertically or horizontally performed accordingly, said pedal means being of elliptical shape and said foot engaging safety member comprises a safety belt, said hand hold means comprising:

(a) a pair of opposing U-shaped hand members separately provided at a top portion of said adjustable vertical frame adapted to be held by the user while performing 360 degree rotating exercises; and (b) a pair of horizontal handle members fixedly connected at a lower end of said opposing U-shaped hand members adapted to be held by the user while performing swinging exercises, wherein one of said horizontal handle members is formed in a curve similar to the curvature of the user's back with soft padding disposed around a periphery thereof for the abutment of the user's back so that, during said exercises, the user can choose gripping positions on either the opposing U-shaped hand members or said horizontal handle members accoridng to the particular exercise to be performed therewith.

* * * * *